US005090324A

United States Patent [19]

Böcker et al.

[11] Patent Number: 5,090,324

[45] Date of Patent: Feb. 25, 1992

[54] WARHEAD

[75] Inventors: Jürgen Böcker, Oberhausen; Wilfried Scheideler, Düsseldorf; Hendrik R. Lips, Düsseldorf; Hans Orth, Düsseldorf; Herbert P. Weisshaupt, Aachen, all of Fed. Rep. of Germany

[73] Assignee: Rheinmetall GmbH, Düsseldorf, Fed. Rep. of Germany

[21] Appl. No.: 466,324

[22] PCT Filed: Jun. 8, 1989

[86] PCT No.: PCT/EP89/00645

§ 371 Date: May 7, 1990

§ 102(e) Date: May 7, 1990

[87] PCT Pub. No.: WO90/02918

PCT Pub. Date: Mar. 22, 1990

[30] Foreign Application Priority Data

Sep. 7, 1988 [DE] Fed. Rep. of Germany ..... 3830347

[51] Int. Cl.[5] ..... F42B 1/00; F42B 1/02

[52] U.S. Cl. ..... 102/307; 102/308; 102/309; 102/476

[58] Field of Search ..... 102/306, 307, 308, 309, 102/310, 476, 506, 501; 299/13

[56] References Cited

U.S. PATENT DOCUMENTS

| | | | |
|---|---|---|---|
| 3,162,121 | 12/1964 | Crawford | 102/24 |
| 3,224,368 | 12/1965 | Hopkins | 102/24 |
| 3,621,916 | 11/1971 | Smith, Jr. | 166/297 |
| 3,760,729 | 9/1973 | Freeman | 102/32 |
| 4,498,367 | 2/1985 | Skolnick et al. | 86/1 R |
| 4,747,350 | 5/1988 | Szecket | 102/306 |

FOREIGN PATENT DOCUMENTS

| | | |
|---|---|---|
| 0105495 | 4/1984 | European Pat. Off. . |
| 2336750 | 4/1975 | Fed. Rep. of Germany . |
| 2927555 | 5/1985 | Fed. Rep. of Germany . |
| 2927556 | 5/1985 | Fed. Rep. of Germany . |

*Primary Examiner*—Brooks H. Hunt
*Assistant Examiner*—Chrisman D. Carroll
*Attorney, Agent, or Firm*—Spencer & Frank

[57] ABSTRACT

A warhead (10') which includes a shaped or projectile forming charge in the form of a liner (14) of a multiphase metallic material or a metal-metal laminate. To prevent the liner (14) from being destroyed by the incoming shock wave and make impossible the formation of a projectile, that is, a shaped charge jet, a layer (15) is arranged, in front of the liner (14) on the side of the explosive, with the layer (15) causing the shock wave front to be flattened and damped and having an acoustic impedance which is lower than that of the liner (14).

8 Claims, 1 Drawing Sheet

WARHEAD

BACKGROUND OF THE INVENTION

The invention relates to a warhead provided with a shaped or projectile forming charge having a liner of a multiphase metallic material as a metal-metal laminate.

Such warheads are disclosed, for example, in German Patent No. 2,927,556. The liner is produced in that ultra-fine particles of heavy metal, for example tungsten, are embedded in a carrier matrix of an ultrafine grain mixture (e.g. Al-Zn alloy).

When such multi-phase materials, particularly, however, those composed of tungsten-heavy metal alloys, such as, for example, W-Cu, WNiFeCo, are reshaped, the liners are frequently destroyed already at the onset of the profile or jet formation. The reason for this is, among others, that due to the great differences in acoustic impedance between the individual phases, the shock waves are reflected at the phase interfaces.

SUMMARY OF THE INVENTION

It is therefore an object of the present invention to further improve warheads of the above-mentioned type so that their liners are not destroyed by the incoming shock wave and therefore a projectile, that is, a shaped charge jet, is formed.

This object is accomplished according to the invention by a warhead provided with a shaped or projectile forming charge arrangement including a casing containing an explosive and a liner of a multi-phase metallic material, with the material being a tungsten-heavy metal alloy; and wherein the surface of the liner facing the explosive is disposed on a first plastic layer which causes the shock wave front to be flattened and dampened and whose acoustic impedance is lower than that of the liner.

According to a further feature of the invention, a second layer formed of a material having a high acoustic impedance, e.g. Armco iron, is disposed between the first layer and the explosive to couple the shock wave into the first layer.

Further particularly advantageous features of the invention are disclosed in the dependent claims.

Thus, the invention is based on the idea of adapting the pressure profile of the shock wave to the material requirements of the liner by disposing a first layer in front of the liner on the side of the explosive. Particularly suitable are plastic layers. They exhibit favorable dispersion and absorption behavior for shock waves and therefore result in flattening of the otherwise very steep shock wave front. Additionally, they have a very low acoustic impedance.

Further details and advantages of the invention will be described below for embodiments thereof and with reference to the drawing figures.

DETAILED DESCRIPTION OF THE PREFERRED EMBODIMENTS

Figure 1:
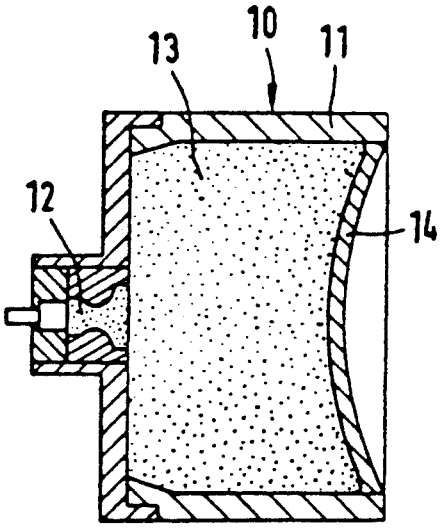
FIG. 1 is a schematic representation of a warhead including a prior art projectile forming liner.

In FIG. 1, the reference numeral 10 identifies the known warhead equipped with a projectile forming liner. It is essentially composed of a warhead casing 11, the explosive capsule with booster charge 12, the explosive 13 and the projectile forming liner 14.

In conventional P charges, the liner 14 is composed, e.g., of copper and, after detonation of explosive 13, is reshaped into a contiguous projectile. As tests have shown, such a projectile formation is not possible if the liner is produced of a multi-phase metallic material or a metal-metal laminate. For example, it has not been possible in the past to produce a contiguous projectile of tungsten heavy metal (WHM) by employing WHM as the projectile forming liner 14.

Figure 2:
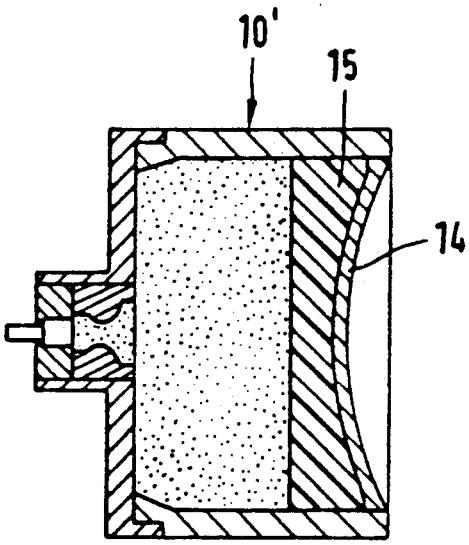
FIG. 2 shows the warhead of FIG. 1 with a first layer according to the invention.

FIG. 2 shows a warhead 10' according to the invention which essentially differs from the warhead 10 of FIG. 1 only by the additional layer 15.

As already described above, the layer 15 not only causes flattening of the otherwise very steep shock wave front and damping of its amplitude, but also acoustic impedance matching to liner 14.

Preferably, layer 15 is composed of a plastic and particularly of a material having low acoustic impedance and good temperature resistance. Polyphenylene oxide (PPO) has been found to be particularly satisfactory in practice for this purpose.

The thickness of layer 15 must be selected so that projectile forming liner 14, which would be destroyed in the conventional charge configuration, remains in effect due to the inventive measures. In a practical embodiment, PPO having a thickness of 10 mm at the apex was employed as layer 15. The liner material was WHM.

Since plastic layers generally have acoustic impedance values which are lower than those of metals and the explosive fumes, the shock wave will be reflected back and forth several times within the plastic layer so that the shock wave energy is successively coupled into the metal liner.

Instead of the plastic layer, a simple metal layer having a low acoustic impedance may also be employed (e.g., lead). This layer absorbs the components reflected at the phase interfaces of liner 14 and converts them to deformation work.

Figure 3:
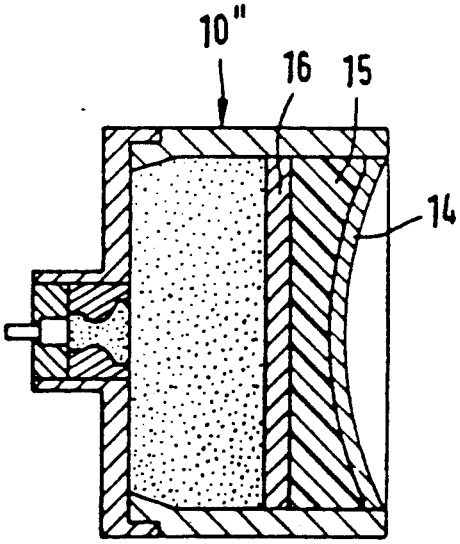
FIG. 3 shows the warhead of FIG. 2 with a second layer according to the invention.

In addition to layer 15, a second, so-called coupling layer 16 may be employed in order to permit the incoming pressure wave to be transferred into layer 15 in the optimum manner. Such an embodiment is shown in FIG. 3. Here the warhead is marked 10'' and the coupling layer is marked 16.

Such coupling layers 16 should preferably be composed of metals having a high acoustic impedance. The thickness of these layers is dependent on material and caliber and, in a practical embodiment, was, for example, 3 mm for a caliber of 35 mm. Armco iron was employed for the layer material.

Figure 4:
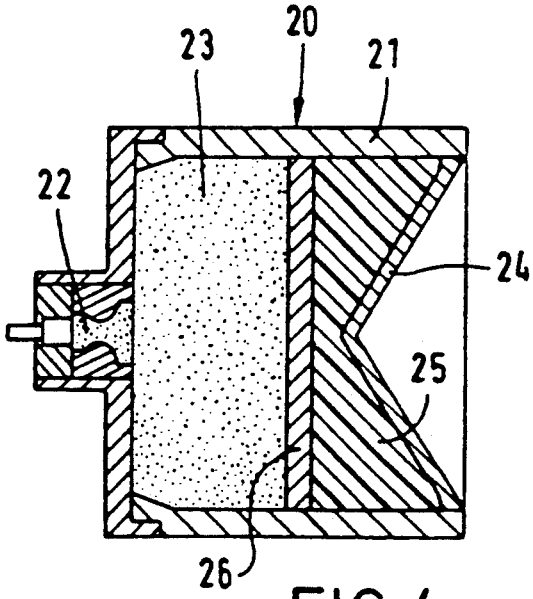
FIG. 4 is a schematic cross-sectional view of a warhead according to the invention with a shaped charge.

FIG. 4 shows the embodiment of a shaped charge equipped with intermediate layers according to the invention. The warhead is here marked 20, the warhead casing is marked 21, the explosive capsule with booster charge is marked 22 and the explosive is marked 23. In front of liner 24 on the side of the explosive, there is a first layer 25 as well as a coupling layer 26.

As in the above-described embodiments, it was possible with the aid of layer 25 to prevent liner 24 from being destroyed by the incoming shock wave which would have made the formation of a shaped charge jet impossible.

We claim:

1. In a warhead provided with a shaped or projectile forming charge arrangement including a casing containing an explosive and a liner of a multi-phase metallic material, with said material being a tungsten-heavy metal alloy; the improvement wherein the surface of said liner facing said explosive is disposed on a first layer which causes the shock wave front to be flattened and dampened and whose acoustic impedance is substantially lower than that of said liner such that the shock wave will be reflected back and forth several times within said first layer, with said first layer being composed of polyphenylene oxide (PPO).

2. In a warhead provided with a shaped or projectile forming charge arrangement including a casing containing an explosive and a liner of a multi-phase metallic material, with said material being a tungsten-heavy metal alloy; the improvement wherein the surface of said liner facing said explosive is disposed on a first layer which causes the shock wave front to be flattened and dampened and whose acoustic impedance is substantially lower than that of said liner such that the shock wave will be reflected back and forth several times within said first layer, with said first layer being composed of plastic, and further comprising a second layer having a high acoustic impedance disposed in front of the first layer on the side of the explosive for coupling the shock wave into said first layer.

3. A warhead according to claim 2, wherein said second layer is composed of a metallic material.

4. A warhead according to claim 3 wherein said second layer is formed of Armco iron.

5. In a warhead provided with a shaped or projectile forming charge arrangement including a casing containing an explosive and a liner of a multi-phase metallic material, with said material being a tungsten-heavy metal alloy; the improvement wherein the surface of said liner facing said explosive is disposed on a first layer which causes the shock wave front to be flattened and dampened and whose acoustic impedance is lower than that of said liner, with said first layer being composed of plastic polyphenylene oxide (PPO).

6. In a warhead provided with a shaped or projectile forming charge arrangement including a casing containing an explosive and a liner of a multi-phase metallic material, with said material being a tungsten-heavy metal alloy; the improvement wherein the surface of said liner facing said explosive is disposed on a first layer which causes the shock wave front to be flattened and dampened and whose acoustic impedance is lower than that of said liner, with said first layer being composed of plastic; and further comprising a second layer having a high acoustic impedance disposed in front of the first layer on the side of the explosive for coupling the shock wave into said first layer.

7. A warhead according to claim 6, wherein said second layer is composed of a metallic material.

8. A warhead according to claim 7 wherein said second layer is formed of Armco iron.

* * * * *